US006239576B1

(12) United States Patent
Breslin et al.

(10) Patent No.: US 6,239,576 B1
(45) Date of Patent: May 29, 2001

(54) SAFE CLASS-2 MOTOR CONTROL CIRCUIT AND METHOD ADAPTED FOR ELECTRIC VACUUM CLEANING SYSTEM SUCTION MOTOR AND AGITATOR MOTOR CONTROL

(75) Inventors: John J. Breslin, *deceased, late of* Los Altos, *by* Eleanor E. Breslin, *legal representative*; James J. McCarthy, Belmont, both of CA (US)

(73) Assignee: Beamco, Inc., Mountain View, CA (US)

( * ) Notice: Subject to any disclaimer, the term of this patent is extended or adjusted under 35 U.S.C. 154(b) by 0 days.

(21) Appl. No.: 09/390,000

(22) Filed: Sep. 3, 1999

Related U.S. Application Data

(60) Provisional application No. 60/099,093, filed on Sep. 4, 1998.

(51) Int. Cl.[7] ..... H02P 5/28

(52) U.S. Cl. ..... 318/805; 15/377

(58) Field of Search ..... 318/38, 787, 803, 318/806, 434; 15/335, 377, 25; 307/38, 116, 141

(56) References Cited

U.S. PATENT DOCUMENTS 3,525,876 8/1970 Breslin .
3,855,665 * 12/1974 Schwartz ..... 15/339
4,021,879 * 5/1977 Brigham ..... 15/319
4,238,689 * 12/1980 Breslin et al. ..... 307/42
4,357,729 * 11/1982 Vander Molen et al. ..... 15/319
5,070,522 * 12/1991 Nilssen ..... 379/90
B1 4,070,586 10/1990 Breslin .

* cited by examiner

*Primary Examiner*—Robert E. Nappi
*Assistant Examiner*—Rina I. Duda
(74) *Attorney, Agent, or Firm*—Flehr Hohbach Test Albritton & Herbert LLP

(57) ABSTRACT

A control circuit for selectively energizing at least one electrical device coupled to the control circuit via a pair of conductive wires with an operating voltage. The control circuit comprises a control circuit for selectively supplying and withholding operating electrical power to at least one electrical device. A first current detector is connected to a control voltage and senses a current flow resulting from closure of a circuit connected to a control voltage in at least one wire of the pair of conductive wires. A second current detector is connected to the operating voltage and senses a current flow resulting from closure of a circuit connected to the operating voltage in at least one wire of the pair of conductive wires. A first switching device responds to the first current detector to disconnect the control voltage from at least one of the wires and to connect the operating voltage to the conductive pair. A second switching device responds to the second current detector to maintain operating voltage to the conductor pair. The second switching device responds to the second current detector to connect operating power to the electrical device.

25 Claims, 5 Drawing Sheets

SAFE CLASS-2 MOTOR CONTROL CIRCUIT AND METHOD ADAPTED FOR ELECTRIC VACUUM CLEANING SYSTEM SUCTION MOTOR AND AGITATOR MOTOR CONTROL

RELATED APPLICATIONS

This application claims the benefit under 35 USC Section 119(e) of U.S. Provisional Patent Application Serial No. 60/099,093 filed Sep. 4, 1998; which is hereby incorporated by reference.

FIELD OF THE INVENTION

This invention pertains generally to an improved electrical control system, more particularly to a safe Class-2 circuit for controlling transmission of operating voltages to electrical machinery and devices, and most particularly to a Class-2 motor control circuit and method adapted for electric vacuum cleaning system suction motor and agitator motor control.

BACKGROUND OF THE INVENTION

The present invention relates to an improved electrical control system, such as may be used to operate a central vacuum cleaning system. The control system will operate a centrally located vacuum turbine motor (or other electrical device) and a remote vacuum cleaning agitator motor (or other electrical device).

In many typical conventional systems, the operating voltage (e.g. 110–125 volts) for the electrical device is provided directly at the wall plate or other receptacle and is present at the receptacle independent of whether the device is connected to the receptacle or not. This presents an unnecessary electrical safety hazard during periods of non-use, or when the device is connected but switched off.

U.S. Pat. No. 3,525,876, is directed to a two-wire power transmission and control circuit which supplies low voltage D.C. power to an agitator motor and which uses a low voltage A.C. control circuit. While the circuit and method described in that patent works satisfactorily in some situations, certain problems, both physical and electrical, may arise because major circuit components had to be constructed in the handle of the remote cleaning unit hose.

U.S. Pat. No. 4,070,586 solved some of the problems associated with then conventional systems, including the system described in U.S. Pat. No. 3,525,876 by providing a system in which the handle of the cleaning unit hose contained only a simple single-pole double-throw switch with a center OFF position together with a small resistance that was used to draw a small current through the wire pair when it is desired to use the A.C. vacuum system without energizing a nominal low-voltage (24 VAC) agitator motor. The wire pair, which is connected through a suitable receptacle associated with the vacuum hose receptacle, was coupled to a power source and the control circuitry which is preferably located at the opposite end of the vacuum cleaning airway at the centrally located A.C. powered vacuum turbine system. The control circuitry included a current sensor which, upon sensing a current in the circuit to either the 24 VAC agitator motor or through the resistance located in the handle of the remote cleaning unit, activated circuitry that energizes the nominal 120 VAC motor coupled to the vacuum turbine. Thus, the operator was able energize the vacuum system by creating a current flow through the low voltage wire pair either by switching on the agitator motor with the turbine motor, or by switching to the resistance that shunted the agitator motor but still provided power to the vacuum turbine motor. U.S. Pat. No. 4,070,586 was thus directed at structure and method for controlling the 120 VAC vacuum turbine motor from a handle mounted switch using a particular two-wire circuit. Unfortunately, this circuit provided 120 VAC to both the vacuum turbine motor and the agitator motor through a single pair of conductors conducting 120 VAC, in order to achieve the desired results. Therefore, while the system and method of U.S. Pat. No. 4,070,586 and the Reexamination certificate B1 4,070,586 provided a very good operational and safety characteristic, additional improvements, not realized at the time, could still be made.

For example, there remained a need for a equipment generally, and for portable and stationary vacuum cleaning equipment in particular, that utilizes a safe Class-2 voltage for control unless the equipment is actually being operated and requires higher voltage, such as a 110–125 volt alternating current (VAC) operating voltage, so that neither the operator nor any service technician are exposed to potentially dangerous voltages when connecting or disconnecting the equipment or when operating the equipment.

SUMMARY OF THE INVENTION

The invention provides structure and method for an improved control system, which is adapted to operate a central vacuum cleaning system's vacuum turbine motor, agitator motor, and a sensor in the handle of the vacuum hose to operate various cleaning devices. The structure and method of the present invention provides a circuit for controlling 120 volt energization of both the vacuum turbine motor and the brush agitator motor using an inherently safe Class-2 circuit, such as a 24 volt circuit, responsive only to a single-pole double-throw switch and sensor contained in the handle of a vacuum cleaner hose when the hose is connected to the Class-2 circuit via a vacuum cleaning wall inlet valve (wall plate) containing a single pair of electrical conductors.

DETAILED DESCRIPTION OF EMBODIMENTS OF THE INVENTION

Figure 1:
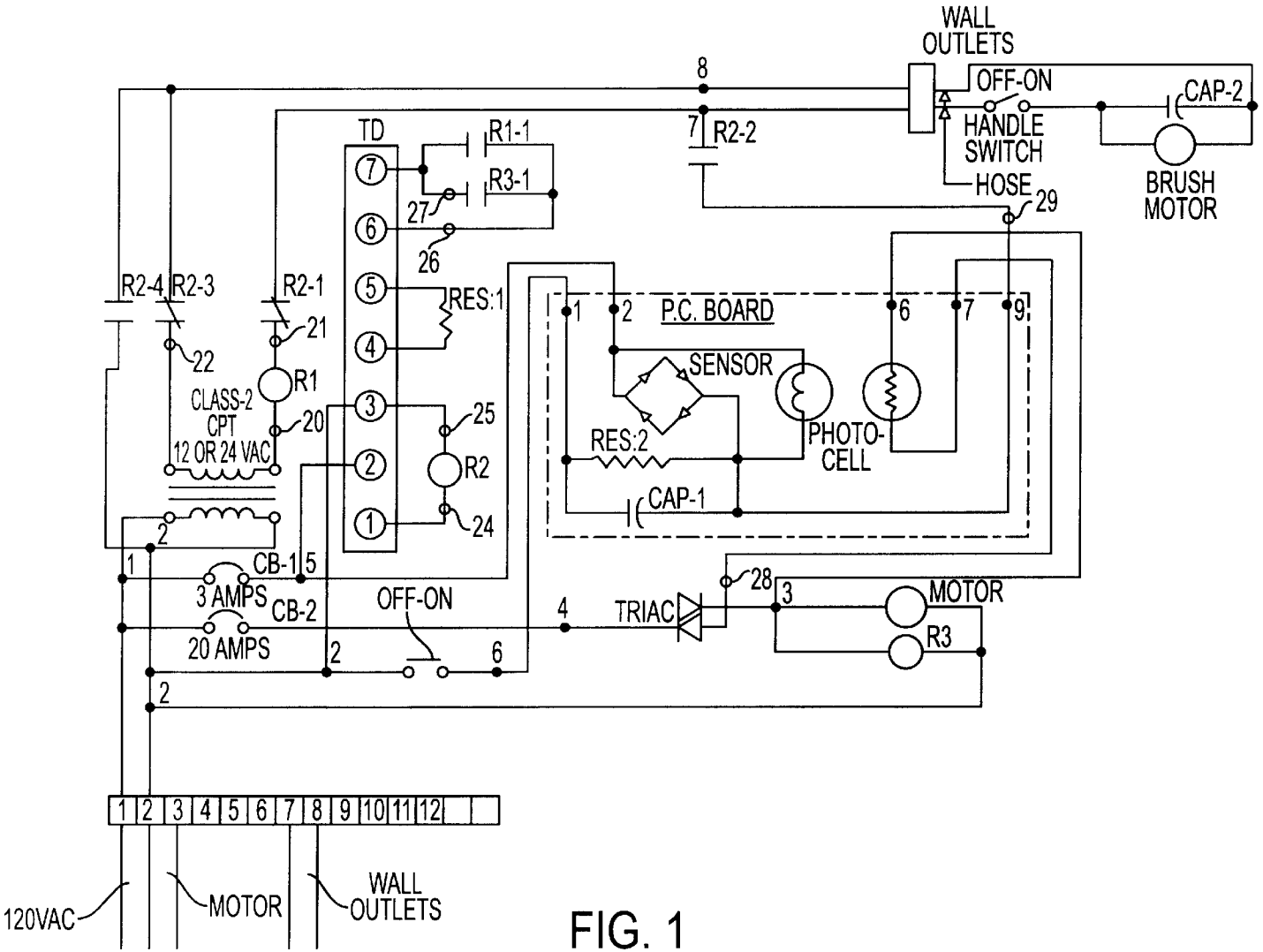
FIG. 1 is an illustration showing a first exemplary embodiment of the inventive circuit, having a relay as a current sensing circuit and a single turbine electric motor.

The present invention relates to an improved electrical control system, such as may be used to operate a central vacuum cleaning system. The control system will operate a centrally located vacuum turbine motor (or motors) and a vacuum cleaning agitator motor. The vacuum turbine motor (or motors) will generally be electric motors rated single-phase, 60 Hz, 120 VAC, but may alternatively be rated single-phase, 60 Hz, 230 VAC by replacing the single-phase, 60 Hz, 120 VAC motor with an interposing relay or contactor, rated single-phase, 60 Hz, 120 VAC. The triac of the control system would then energize the 120 VAC coil of the relay or contactor instead of the vacuum turbine motor and the relay's normally-open (NO) contact would energize a single phase, 60 Hz, 230 VAC electric motor starter. Consequently, the control system is capable of operating motors of various voltages and horsepower combinations, for example, including but not limited to, three-phase, 60 Hz, 230 VAC or 460 VAC, by selecting the correct motor starter. Other frequencies besides 60 Hz may be used, such as for example, 50 Hz, 100 Hz, 120 Hz, and other frequencies. The circuit may also be used with direct current (DC) voltages and currents with minor modifications. It is noted that the system and circuits described herein are "low voltage" as the National Electrical Code of the United States defines high voltage at 600 volts and higher.

Two electrical conductors connect the control system to the cleaning unit. This permits the operator to switch on the vacuum agitator motor or the vacuum system at the handle of the vacuum hose. A class-2 voltage, 24 VAC, is present at the handle of the hose when the single-pole double-throw switch is in the off position. Moving the switch in either direction removes the 24 VAC and applies 120 VAC to energize the vacuum turbine motor and depending upon the switch position the vacuum agitator motor as well.

Several embodiments of the inventive circuit are shown and described here, each embodying the same inventive principle. We first describe a structure and operation of the invention in general terms, we then provide a detailed description of particular embodiments of the invention with respect to the drawings.

In each of the embodiments, the control circuit and method encompass all Class-2 voltages, alternating current (AC) or direct current (DC), and are capable of simultaneously energizing a first motor or other electrical device (such as for example, the main turbine motor of a central vacuum cleaning system) and a second electrical device (such as for example, an agitator motor of the remote cleaning unit of the same central vacuum cleaning system) by means of a single pair of conductors. In these circuits, a Class-2 voltage is applied to a pair of electrical contacts or wires in a receptacle such as those on wall face plates (wall plates) of the system (e.g central vacuum cleaning system) with a sensing circuit in series with the face plates.

In one embodiment of the invention (See FIG. 2) the sensing circuit comprises the coil (R1) of a low voltage (e.g. 24 Volt) relay in series with the face plates, in another embodiment of the invention (See FIG. 3) the sensing circuit comprises a transformer, and in a third embodiment of the invention (See FIG. 1 and FIG. 4) the sensing circuit comprises a diode bridge circuit in parallel with a photo diode-photocell pair. A fifth embodiment of the inventive circuit is modified to provide a Class-2 direct current control circuitry. These alternatives embodiments and others are described in greater detail below.

We first describe a detailed operation of the invention with respect to the embodiment of FIG. 1. As stated, the Class-2 voltage is applied to a pair of electrical contacts or wires connected to the wall face plates of the central vacuum cleaning system with a sensing circuit in series with the face plates. In this embodiment, the sensing circuit comprises the coil (R1) of a low voltage (e.g. 24 Volt) relay in series with the face plates. The wall face plates provide convenient coupling of the vacuum hose which conveys the vacuum pressure generated air flow and electrical contacts for powering an agitator motor (such as is used with a floor or carpet cleaning agitator brush) at the remote cleaning unit. The term "cleaning hose" refers to the portion of the central vacuum cleaning system that extends from the face plate coupling, including the hose that provides a conduit for air flow, the handle and handle mounted switch and other electrical components, and the wand which extends from the handle to other cleaning nozzles or other accessories at the terminal end of the remote unit, including for example the agitator motor, although usually we refer to this agitator motor separately.

A class-2 voltage appears at the face plates but does not energize the coil of relay R1 until (i) the cleaning hose is plugged into the face plate, and (ii) the switch in the handle of this cleaning hose is put into the "ON" position. The Class-2 circuit connection is then completed through the switch by means of the agitator motor or the circuit in the handle of the cleaning hose in series with relay R1 which connection energizes relay R1 causing its contact to energize time delay relay TDR. TDR energizes by means of its 120 VAC. Second relay (relay R2) removes the Class-2 voltage from the face plates and applies 120 VAC to the same face plates through a two wire circuit. (An early example of a two-wire circuit is described in U.S. Pat. No. 4,070,586 and Reexamination Certificate B1 4,070,586, each of which are hereby incorporated by reference.) Simultaneously, the vacuum turbine motor and a third relay, relay R3, are energized. Relay R3 continues the energization of the time delay relay TDR causing the central vacuum cleaning system to operate. Relay R3 contacts are electrically parallel to relay R1 contacts. In the particular embodiment of FIG. 1, relay R1, R2, and R3 are electro-mechanical devices; however, in general they may be electro-mechanical devices, solid-state devices or components, a combination of solid-state devices, and/or combinations of electro-mechanical and solid-state devices or components. When the switch in the handle of the cleaning hose is put into the "OFF" position, or the cleaning hose removed from the wall plate, the time delay relay (TDR) circuit times out, and the 120 VAC is removed from the conductors at the wall plate and as a result removed from all circuits and conductors within the cleaning hose and wand, and restoring the Class-2 control voltage to the wall plate. In one embodiment, a resistor (or variable potentiometer) coupled across terminals of a commercial time delay relay are used to adjust the amount of time delay associated with the device. A time delay of about 1 second is conveniently used, though time delays of from about ½ second to about 2 seconds may typically be employed.

Figure 2:
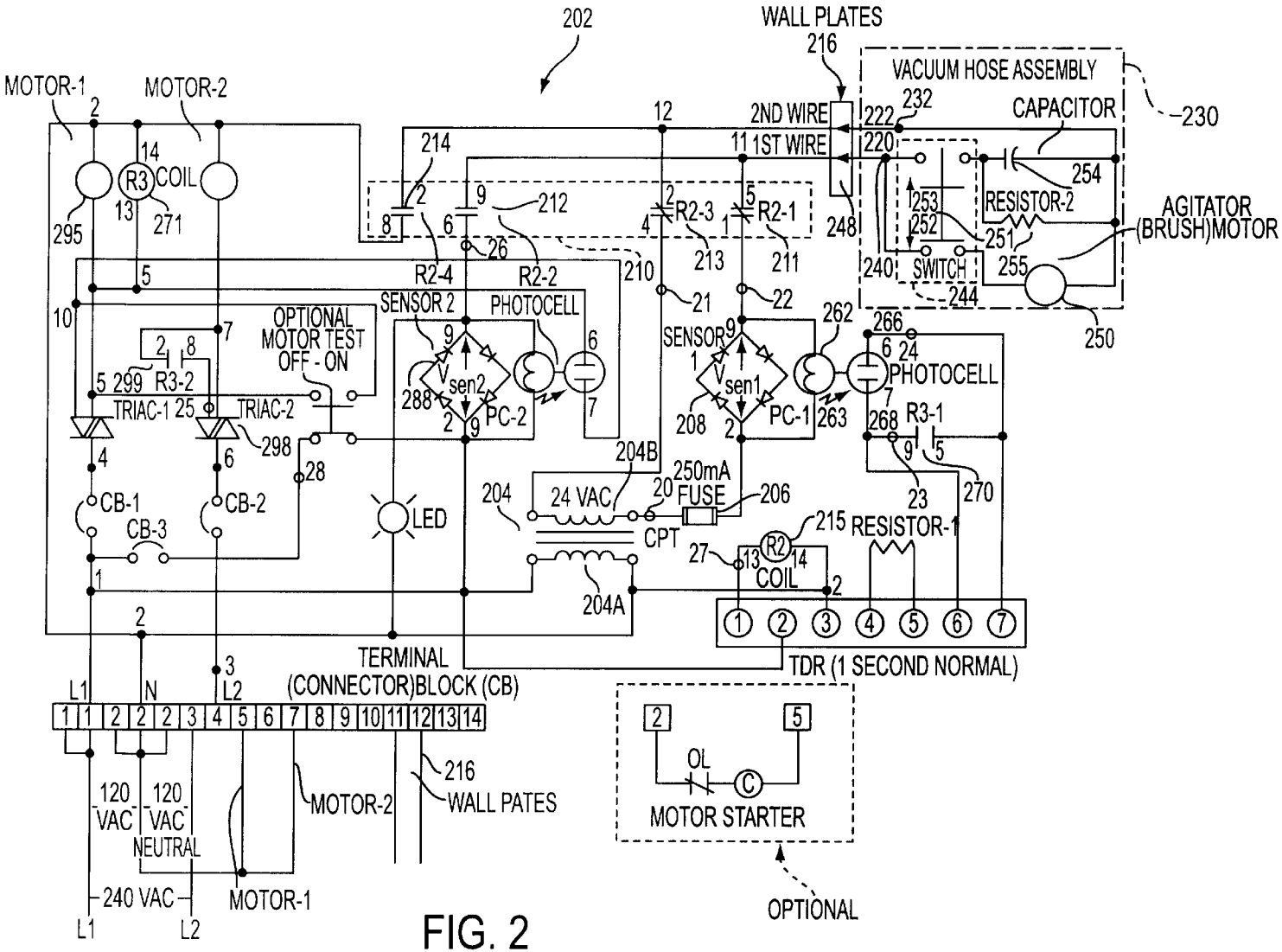
FIG. 2 is an illustration showing a second exemplary embodiment of the inventive control circuit, having hard-wired connections at a terminal block and a sensor for controlling electrical devices, such as two electric motors in a central vacuum cleaning system.
Figure 3:
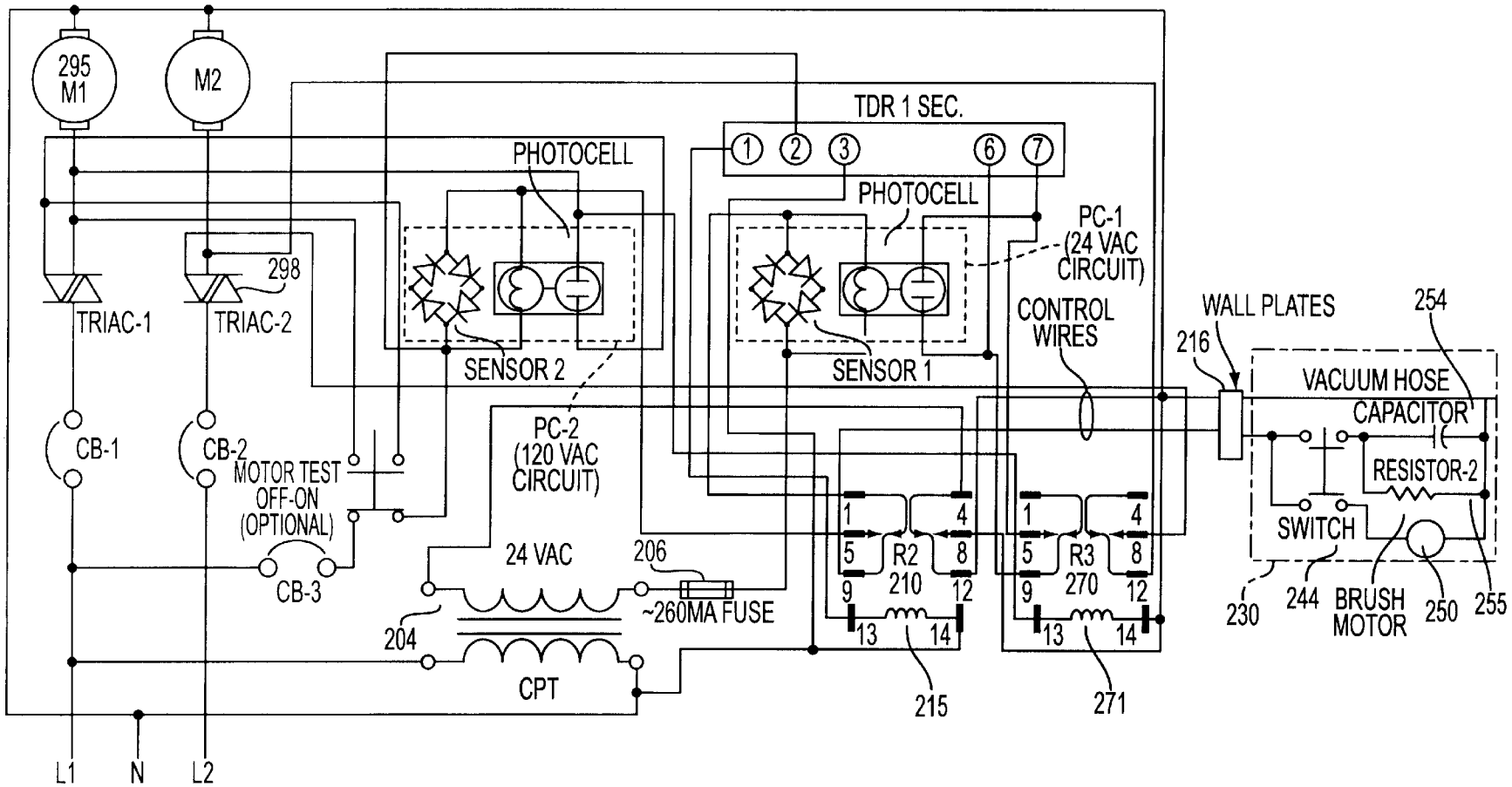
FIG. 3 is an illustration showing a third exemplary embodiment of the inventive circuit, explicitly showing the contact structure of the relays in the embodiment of FIG. 2.

We next turn our attention to a description of FIG. 2 and FIG. 3, which are preferred embodiments of the invention. FIG. 2 illustrates an embodiment having hard-wired connections at a terminal block, while FIG. 3 shows a variation of that same circuit but including a different schematic illustration of the several relay contacts involved with operation of the system. Some variation of components also exist. For example, in the embodiment of FIG. 2, an explicit resistor is provided across terminals 4 and 5 to control the time delay period, whereas in the FIG. 3 embodiment, control of the time delay is provided for internally, such as by a resistor encapsulated into a commercial device. It is noted that time delay relays of various types are known in the art, including so called "delay on break" or "de-energization" and "delay on make" or "energization". Time delay relay (TDR) is of the "delay on break type. One delay on break time delay relay which may conveniently be used in the inventive circuit is a Model Q3F Series relay made by National Controls Corporation (Tel. 708-231-5900), though comparable devices made by other manufacturers may alternatively be used. By way of background for one exemplary timing device, the National Controls Corporation Q3F series solid-state timer operates as follows: Input voltage is applied to the timer at all times, and upon closure of a normally open isolated start switch, the load energizes and remains energized as long as the switch is closed. When the start switch opens, the timing cycle starts, and at the end of the preset time delay, the load de-energizes and the timer is ready for a new timing cycle.

Referring now to the drawings, FIG. 2 is a schematic diagram illustrating an exemplary embodiment of the inventive circuit structure and method of controlling a vacuum turbine motor. The vacuum turbine motor is mechanically coupled to an air turbine or impeller in the vacuum airway of a vacuum cleaning system that includes one or more remote flexible cleaning units suitably coupled to the airway via a hose or hoses through an outlet receptacle or wall plate. The vacuum turbine motor is electrically and photo-electrically coupled to the inventive circuit structure. The wall plate includes a coupling for vacuum and air flow and suitable electrical connectors for operating and control signals, described in greater detail hereinafter. Each cleaning unit typically includes a flexible vacuum hose connected between the wall plate (receptacle) and a cleaning wand having, at its lower end, a nozzle (or other cleaning attachment) containing a rotary brush mechanically driven by an agitator motor.

The inventive structure and method are applicable to a variety of electrical appliances and are not limited to controlling a vacuum turbine motor and/or an agitator motor; however, the invention is described in terms of these devices and systems as the invention has particular relevance and applicability to fixed or central vacuum cleaning systems and portable vacuum cleaning systems as well as other motor driven equipment.

The inventive structure and method provides a Class-2 control signal (in one embodiment a 24 VAC signal) at a wall face plate (wall plate or receptacle), and communicates that Class-2 control signal from the wall plate to a switch (for example a slide, toggle, or other switch) in the handle (or wand) of a remote cleaning unit via a two-conductor pair of wires attached to the vacuum hose. When the switch is placed in the ON position, the Class-2 control voltage is used to transition from the Class-2 control voltage to a higher operating voltage, such as a 110–120 VAC motor operating voltage. In addition to the 110–120 VAC operating voltage range, the operating voltage may also be in the range of between about 100 volts and about 250 volts, as well as 230 volt and 460 volt operating voltages. It will also be understood that although these represent exemplary voltage ranges for the type of electrical devices benefitting from the invention, the invention is suitable for and intended to encompass high, as well as low, voltage devices. The invention is inherently safe because only safe Class-2 voltages are exposed to the equipment operator. For example, even the voltage at the wall face plate is only a Class-2 voltage when a vacuum hose is plugged in and the switch in the handle is turned to the OFF position. The structure and operation of the invention is described in greater detail hereinafter.

The embodiment of the inventive structure 202 illustrated in FIG. 2 incorporates a 120/24 volt transformer 204 in series with a fuse 206 rated at 250 milliamps (mA), a sensor circuit (sensor-1) 208, and normally closed contact (R2-1) 211 of second relay 210 connected to wall plate 216. It is noted that the first relay (relay R1) which appears in the embodiment of FIG. 1, is replaced by a bridge circuit/photo diode-photocell sensing circuit in this embodiment. The transformer's neutral wire is serially connected through the normally closed third contact (R2-3) 213 of second relay 210 to wall plate 216. The transformer's 204 secondary winding 204*b* applies 24 volts AC to a single wall plate 216 by means of the afore described circuits. Only two conductors are utilized, which connect the transformer to the wall plate, a first conductor 220 and a second conductor 222. The single wall plate 216 may alternatively be replaced or augmented by a plurality of wall plates, and when multiple wall plates are provided they are connected in parallel.

The safe Class-2 24 volt AC will remain at the wall plates until vacuum hose assembly 230 is connected to wall plate 216. Vacuum hose assembly 230 comprises a hose or other plumbing 232 that communicates a vacuum between a mating vacuum coupling 232 at wall plate 216 (which is itself coupled to or otherwise in fluid communication with a vacuum source) and a handle and/or wand assembly 236, and electrical components 238 which include a first wire 240, a second wire 242, a simple single-pole double-throw switch 244, a capacitance 246, and a fail-safe connection 248 from the electrical conductors 218, 220 of wall-plate 216 to agitator motor 250. Agitator motor 250 is located at a peripheral portion of wand assembly 236 and is responsible for operating a brush and beater bar, or the like member for agitating the carpet, floor, or other surface that is being cleaned so that the dirt or other debris is more readily picked up in the stream or moving air that results from the vacuum.

Fail-safe connection 248 is formed by providing the voltage at wall-plate 216 on female-type connections (active or hot electrical conductors are recessed within a hole or socket) while the conductors in hose assembly 230 communicating electrical voltage to the agitator motor 250 are provided as a male-type connection (conductors protrude from an insulated connector shell) so that for example, the 120 VAC operating voltage is present only within the female-type connector when the hose assembly 230 is not connected to the wall plate, and once the hose assembly is connected, the male-type conductors are concealed within the wall plate. Therefore, no voltage is ever present on the male-type connections that might create an electrical problem for the equipment, or an electrocution hazard to the user.

Switch 244 may be a simple single-pole double-throw switch. In a first switch position (OFF position), switch 244 is open and does not complete an electrical circuit and no alternating current flows between the first and second wall plate conductors 220, 222. In a second switch position (agitator motor position), switch 244 completes an electrical circuit from first wall plate conductor 220 through agitator (brush) motor 250 to second wall plate conductor 222. In a third switch position (vacuum position), switch 244 completes an electrical circuit from first wall plate conductor 220 through the parallel combination of capacitor 254 and resistor (resistor-2) 255 to second wall plate conductor 222. Note that in the embodiment of FIG. 2, the agitator motor 250, and the parallel combination of capacitor 254 and resistor 255, are arranged in parallel so that when switch 244 is in either the second or third switch positions electrical current flows through first wire 240 and second wire 242 (either via the capacitor/resistor combination or agitator motor). Second wire 242 coupled to second wall plate conductor 222 and to each of the capacitor 254 and resistor 255 is a neutral (N) wire. In one embodiment of the invention, the second switch position turns on the vacuum and the agitator motor, while the third switch position only turns on the vacuum.

Capacitor 254 is operative to substitute for the agitator motor characteristics to achieve current flow in the circuit when the switch 244 is paced in the vacuum position 253, and is out of the circuit when the switch 244 is placed in the vacuum and agitator position 252. Resistor 255 is operative to bleed charge off (discharge) the capacitor 254.

The secondary of the 120/24 volt transformer puts 24 volts at the face plate through the circuit, which contains the fuse, sensor-1, and the relay's R2 normally closed ("NC") contact R2-1, and the neutral circuit through relay's R2 "NC" contact R2-3. Since there is no cleaning hose plugged into the wall plate, 24 volts remain on the wall plate or plates. If the cleaning hose is plugged into the wall plate or wall plates and the switch 244 in the handle is in OFF position, 24 volts remain at the wall plate or wall plates and at the handle of the cleaning hose. When the single-pole double-throw switch in the handle of the hose is placed in either the "on" positions, the second relay R2 transfers its contacts. In one embodiment, two "on" positions are provided, on the energizes the vacuum turbine motor alone, and another that energizes both the vacuum turbine motor and the agitator motor. Relay contacts R2-1 and R2-3 are opened, removing 24 volts from the wall pate or wall plates. Relay R2 normally-open ("NO") contacts R2-2 and R2-4 close, putting 120 volts at the wall plate or wall plates through the cleaning hose to operate either the agitator motor or the vacuum cleaning system, or both. Second sensor (sensor-2) is in series with the relay contact R2-2 and senses the 120 volts. The terminals of its photocell energize triac-1, and triac-1 turns on the vacuum motor turbine system and relay R3. If two motors are required to boost the performance of the vacuum turbine system, "NO" contacts of relay R3 energize a second triac, triac-2, which turns on the second turbine motor (motor-2). In the embodiments shown and described here, the relays are electro-mechanical devices; however, solid state devices, hybrid electro-mechanical/solid-state devices, or combinations of electro-mechanical and solid state devices may be used. Having the first and second sensor circuits (for example, sensor-1 and sensor-2 or their equivalents) and time delay relay (or equivalent) are important for the operation of the inventive class-2 control circuit.

The flow of control current 260 through sensor circuit 208, which in one embodiment of the invention comprises a four-diode bridge circuit, generates a sensor output voltage (Vsen) across the sensor of between about 1.2 volts and about 1.6 volts, more usually between about 1.3 volts and about 1.5 volts. In one embodiment, each of first and second current detectors comprise an optical photo-cell pair including a light emitting portion and a light detecting portion, the light emitting portion operating when a sufficient current passes through the light emitting portion, the light detecting portion disposed to collect and sense light emitted by the light emitting portion and causing generation of a signal for controlling another circuit device. Here, a photo-diode 262 is optically coupled to photocell 264 which receives the 1.3 volt to 1.5 volts from the diode-bridge of the sensor 208 turning on its dry terminals 266, 268 which in turn energizes TDR 270. The time delay relay (TDR) supplies voltage to second relay (relay-2) 210. This sensor output voltage is sufficient when applied to the terminals of a light emitting diode (photo diode) 262 to cause light 263 to be emitted. The photo diode 262 is placed proximate to a photo-receptive cell (photocell) 264, and the light 263 emitted from photo diode 262 is received by the photocell. Note that in one embodiment of the invention, the photo diode and the photocell are an integrated device purchased as a commercial component. The optical coupling is advantageously used as it provides complete electrical isolation. Where this type of isolation is not required, other sensor circuit structures may be employed.

Time delay relay 270 has a one or two second delay, one second normally being sufficient. When the time delay relay 270 is energized as a result of the actuation of the photocell's terminals 266, 268, it energizes the coil 215 of second relay R2 utilizing the 120 VAC applied to its terminals. The operation of the second relay's (R2) contacts have been previously described.

An off-delay time delay relay (for example, a "delay on break" type relay or solid-state timer) is provided to accommodate mechanical switching times associated with activation and deactivation of the electro-mechanical relays, the time for the service point of the relay contact to move between normally closed and normally open positions. Where all solid state devices are employed in place of electro-mechanical devices, alternative time delay or timer circuits and methods may be employed to provide the desired sequencing and protection.

It is noted that as the 24 VAC and 120 VAC circuits are separate (different sets of relay contacts are used), that there is not overlap or superposition of the 24 VAC and 120 VAC signals. A fuse 206 is advantageously but optionally provided in the circuit that is selected to be as low as possible so that the short occurs during 24 VAC operation rather than waiting for 120 VAC operation. (A fuse may be required to satisfy National Electrical Code requirements and/or to satisfy Underwriters Laboratory (UL) certification requirements, and in any event would represent good electrical practice, and should be used but is not a requirement of the inventive circuit.) A small on-delay type time delay relay (or other timer) may optionally, but advantageously be provided so that in the event of a short circuit within the 24 VAC circuit, fuse 260 will blow before the 120 VAC turns on. For example, a "delay on make" type time delay relay or solid-state timer circuit may be used, such as for example the National Controls Corporation Model Series Q1F where upon application of an input voltage, the delay starts, and at the end of the time delay, the load is energized and reset may be accomplished by removing the input voltage.

Current produced by the 120 VAC input passes through second sensor circuit (sensor-2) 288 and generating a voltage signal (Vsen2) across a second photo diode 289 which is received by a second photocell 290, causing second photocell 290 to close its terminals. Second photocell 290 is connected across output and gate terminals 291, 292 of a first triac (triac-1) 294. Closing the photocell terminals activates or energizes first triac 294, and once energized, first triac 294 connects 120 VAC to vacuum turbine motor 295 and to the coil (R2) 271. Vacuum turbine motor produces the vacuum in the system.

The vacuum turbine motor 295 and coil 271 of third relay R3 271 are connected in parallel and are energized together. In addition, one set of contacts of third relay 271 is parallel with the contacts of the first sensor 208 in order to maintain the time delay when the 24 VAC circuit is disconnected.

When the switch 244 is toggled to the either the second or third position, the vacuum turbine motor 295 is turned on, creating the vacuum and consequent air flow in the system, as normally vacuum is desired for all cleaning operations, and some cleaning applications will further require agitator motor activation and others involving different cleaning implements will not. Moving the single-pole double-throw switch 244 to the off position, or disconnecting the hose from the wall plate 216, removes the 120 VAC and restores the 24 VAC at the wall plate or wall plates, after the time delay has timed out. Toggling the switch 244 to the off position 251 initiates the 1 to 2 second time delay period, which upon expiration removes the 120 VAC from the wall plate 216 and reapplies the 24 VAC safe Class-2 control voltage.

In a situation where it is desired to have a second vacuum turbine motor, a second triac 298 is energized by a second normally open contact (R3-2) 299 of third relay 271, which supplies 120 VAC to the second turbine motor. This second turbine motor circuit is separate from the first circuit, as in at least the embodiment illustrated, the current handling capacity of the diodes in sensor circuit (about 5 amps) are not sufficient to support both motors; however, in an alternative embodiment, the capacity of the sensor may be increased to accommodate the additional load, or additional sensor circuits may be provided. In any event, the circuit shown for energizing the second turbine motor is the most straight forward and cost effective solution. Any number of additional motors or other devices may readily be added and controlled in the same manner so long a multiple contacts are provided. Provision of the electrical contact across the triac provided by the relay is sufficient to energize the triac and allow current to flow through them. For two turbine motors, a relay contact will gate the triac (triac-2) for the second motor (motor-2). An additional set of contacts, such as a the contacts in a triple-pole relay, provide the contact needed to gate a third triac (not shown) and operate a third motor (not shown). This may be extended to operate additional triacs and electrical devices or motors.

Figure 4:
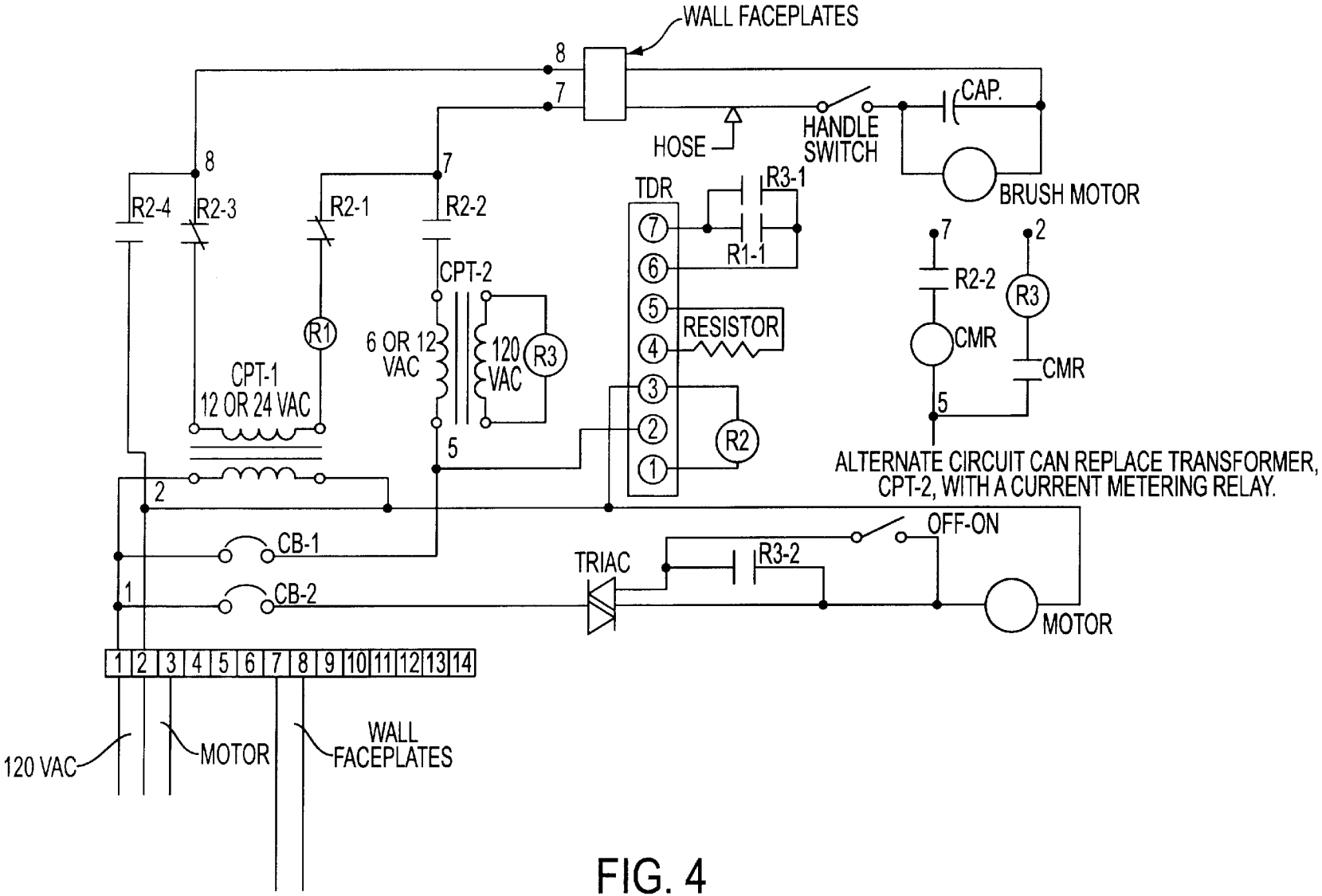
FIG. 4 is an illustration showing a fourth exemplary embodiment of the inventive circuit, utilizing a transformer in the 120 volt circuit in place of one of the sensor circuits in the embodiment of FIG. 1.

A fourth embodiment is illustrated in FIG. 4 and shows how an safe Class-2 transformer, current metering relay, or similar solid state or electro-mechanical device, might be used to replace a current sensor circuit described relative to the embodiment in FIG. 1 in the same two-wire circuit. Values of certain electrical components would be changed to match the electrical characteristics of the replaced components, but these changes are within the skill of workers having ordinary skill in the art and are not described here in greater detail.

Figure 5:
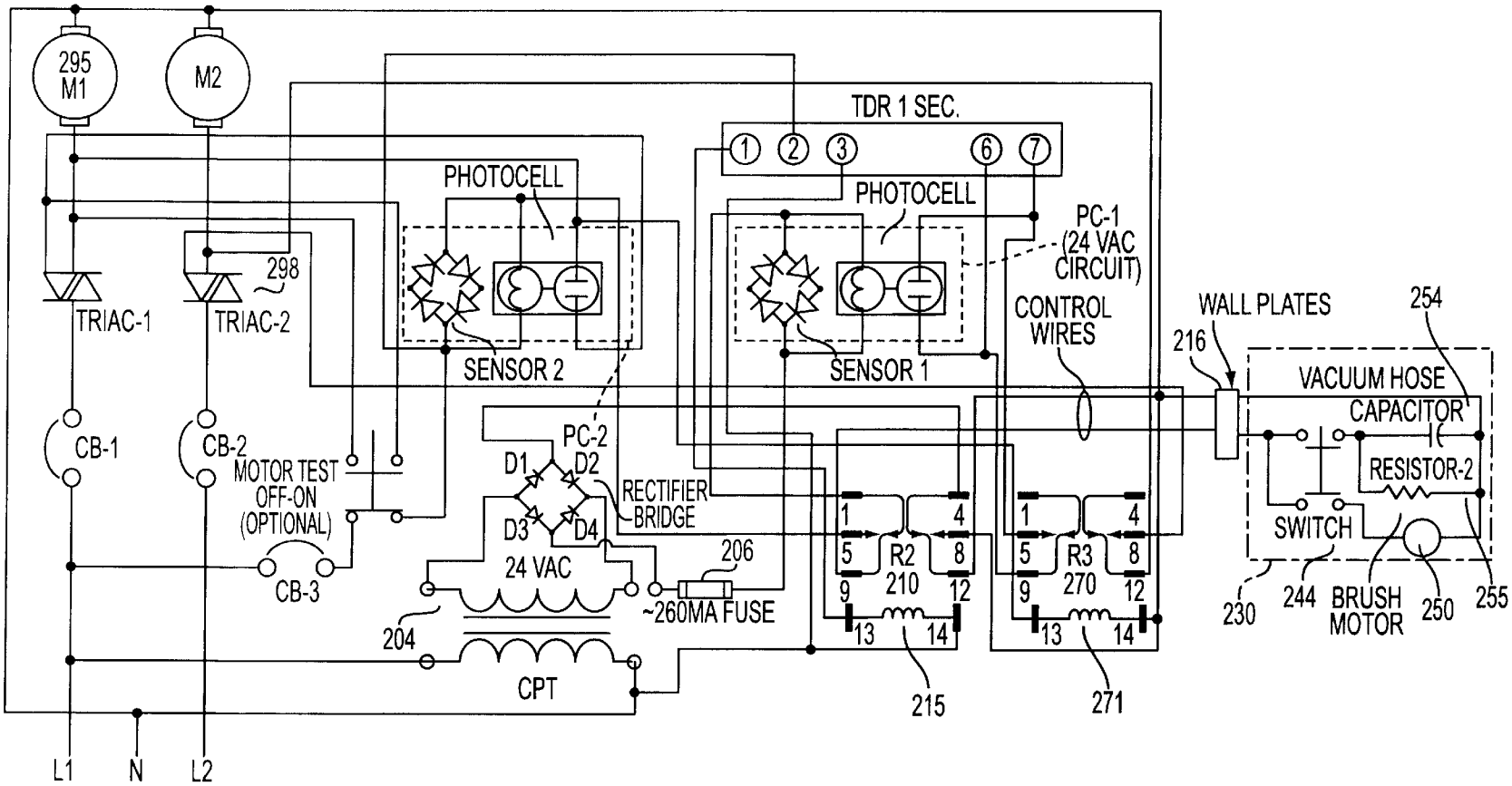
FIG. 5 is an illustration showing a fifth exemplary embodiment of the inventive circuit that is adapted for Class-2 direct current (DC) operation.

A fifth embodiment of the inventive circuit is illustrated in FIG. 5 and shows one manner in which the inventive circuit of FIG. 3 may be modified to provide a safe 24 volt direct current (24 VDC) Class-2 control circuit. In this embodiment, a rectifier circuit, such as a four diode rectifier bridge circuit having first (D1), second (D2), third (D3), and fourth (D4) diodes receives the 24 VAC signal from the 120/24 transformer. The output of the rectifier circuit is a DC voltage which replaces the 24 VAC signal already described. Additional filtering circuitry may be provided to reduce or eliminate any signal ripple that may result from the signal rectification. Of course other DC voltages may alternatively be provided.

Those workers having ordinary skill in the art will appreciate that modifications and changes may be made to the particular embodiments shown and described. For example, electronic switches and control systems may replace electro-mechanical relays, different sensor circuits may be utilized and additional relays could be used in place of the sensor circuits, current metering relays may be used in place of the sensor circuits, as could substitutes for the photo diode-photocell combinations. Solid state devices may be substituted for mechanical or electro-mechanical components, and although not preferred, mechanical and electro-mechanical components may be substituted for solid state components (such as the triac devices). Each switch has an equivalent electronic version, optical version, mechanical version, and the like.

The inventive circuit may be hardwired using discrete components on a circuit board, metal or other (insulated) frame, or the like. This is particularly advantageous where electro-mechanical relays are used which require physical space and mounting sockets. In one embodiment of the invention, the electro-mechanical relays are of a type made by National Controls Corporation, but equivalent relays made by Line Electric, Square-D, Idec, or other manufacturers may be used.

In another embodiment, the inventive circuit is implemented as a printed circuit board. (PCB) This is particularly advantageous where there is a desire to reduce the physical size, or when solid state components are substituted for the electro-mechanical relays and other components. Hybrid implementations having hard wired and PCB components may also be advantageously used.

Although several embodiments of the invention have been described, it should be understood that the invention is not intended to be limited to the specifics of these embodiments. For example, even though the foregoing description refers to the circuits as being particularly for use in permanently installed vacuum cleaning systems having a centrally located AC power turbine and one or more remote cleaning units equipped with low voltage agitator motors, it should be understood that the circuits are also usable and intended for use with high voltage agitator motors and/or in portable vacuum cleaners wherein the power turbine is located in a portable canister and the electric motor driven agitator is located on a cleaning wand connected to the canister by a flexible conduit similar to that of the afore described permanently installed vacuum cleaning systems. Accordingly, as used in the accompanying claims, reference to central electrical devices is intended to encompass both permanently installed central devices and portable central devices and reference to remote electrical devices, unless specifically defined otherwise, is intended to encompass high, as well as low, voltage devices.

All publications and patent applications cited in this specification are herein incorporated by reference as if each individual publication or patent application were specifically and individually indicated to be incorporated by reference.

We claim:

1. A control circuit for selectively energizing at least one electrical device coupled to said control circuit via a pair of conductive wires with an operating voltage between 100 volts and 250 volts, said control circuit comprising:

a control circuit for selectively supplying and withholding operating electrical power to said at least one electrical device;

a first current detector connected to a control voltage less than said operating voltage and sensing a current flow resulting from closure of a circuit connected to said control voltage but not connected to said operating voltage in at least one wire of said pair of conductive wires;

a second current detector connected to said operating voltage and sensing a current flow resulting from closure of a circuit when connected to said operating voltage in at least one wire of said pair of conductive wires;

a first switching device responsive to said first current detector to disconnect said control voltage from at least one of said wires and to connect said operating voltage to said conductive pair of wires;

a second switching device responsive to said second current detector to maintain said operating voltage to said pair of conductive wires, said second switching device responsive to said second current detector to connect said operating power to said electrical device; and a delay circuit delaying connecting said operating voltage to said electrical device for a predetermined time to allow a safe transition from said control voltage to said operating voltage over said common pair of conductors.

2. The control circuit in claim 1, wherein said control voltage is a class-2 voltage.

3. The control circuit in claim 1, wherein said operating voltage is a voltage sufficient to provide sufficient voltage and current for operating said electrical device, said electrical device being selected from the group of electrical devices consisting of an electric motor, a vacuum cleaner agitator motor, a vacuum cleaner brush motor, a central vacuum cleaning system suction motor, a portable vacuum cleaner motor, and combinations thereof.

4. The control circuit in claim 1, wherein said operating voltage is a voltage in the range between about 100 volts and about 250 volts.

5. The control circuit in claim 1, wherein each of said first and second current detectors comprise an optical photo-cell pair including a light emitting portion and a light detecting portion, said light emitting portion operating when a sufficient current passes through said light emitting portion, said light detecting portion disposed to collect and sense light emitted by said light emitting portion and causing generation of a signal for controlling another circuit device.

6. A control system for selectively energizing and supplying power to a central and a remote electrical load device interconnected by a single connector pair from a common control located at the remote device comprising:

a. low voltage circuit having a value of voltage not hazardous for personnel for sensing when said common control is connected and activated;

b. power means at the location of the central electrical device for providing power to the conductor pair interconnecting said central device with the remote electrical device, said power means providing electrical voltage to said conductor pair;

c. said common control comprising switching means interposed in one conductor of said pair for conducting the flow of electrical current to said remote device, said switching means comprising a switch having a first position for conducting electrical current to said remote electrical device and a second position for preventing the conducting of electrical current to said remote device;

d. first detecting means at the location of said control device connected to said low voltage and interposed in one conductor of said pair for detecting an electrical current flow through said conductor pair, said detecting means comprising a current sensing device interposed in one of said pair;

e. second detecting means at the location of said control device connected to said power means and interposed in one conductor of said pair for detecting an electrical current flow through said conductor pair, said detecting means comprising a current sensing device interposed in one of said pair;

f. first actuating means responsive to current flow detected by said first detecting means for disconnecting said low voltage from said conductor pair and connecting said power means to said conductor pair;

g. second actuating means responsive to current flow detected by said second detecting means for maintaining connecting said power means to said conductor pair; and h. said second actuating means responsive to current flow detected by said second detecting means for further connecting said power means to said central electrical device.

7. A control system for selectively energizing and supplying power to a central and a remote electrical load device interconnected by a single connector pair from a common control located at the remote device comprising:

a. low voltage circuit having a value of voltage not hazardous for personnel for sensing when said common control is connected and activated;

b. power means at the location of the central electrical device for providing power to the conductor pair interconnecting said central device with the remote electrical device, said power means providing electrical voltage to said conductor pair;

c. said common control comprising switching means interposed in one conductor of said pair for conducting the flow of electrical current to said remote device, said switching means comprising a switch having a first position for conducting electrical current to said remote electrical device and a second position for preventing the conducting of electrical current to said remote device;

d. first detecting means at the location of said control device connected to said low voltage and interposed in one conductor of said pair for detecting an electrical current flow through said conductor pair, said detecting means comprising a current sensing device interposed in one of said pair;

e. second detecting means at the location of said control device connected to said power means and interposed in one conductor of said pair for detecting an electrical current flow through said conductor pair, said detecting means comprising a current sensing device interposed in one of said pair;

f. first actuating means responsive to current flow detected by said first detecting means for disconnecting said low voltage from said conductor pair and connecting said power means to said conductor pair;

g. second actuating means responsive to current flow detected by said second detecting means for maintaining connecting said power means to said conductor pair;

h. said second actuating means responsive to current flow detected by said second detecting means for further connecting said power means to said central electrical device; and i. a delay circuit delaying said first actuating means disconnecting said low voltage from said remote electrical device and connecting said power means to said remote electrical device responsive to said first detecting means for a predetermined time.

8. A circuit for selectively energizing an electrical device, said circuit comprising:

first and second current detectors, each sensing current flow or a lack of current flow in a wire of a pair of conductive wires;

a first switching device responsive to said first current detector to disconnect a control voltage from at least one of said wires and to connect a operating voltage to said conductive pair;

a second switching device responsive to said second current detector to maintain said operating voltage to said conductor pair, said second switching device responsive to said second current detector to connect said operating power to said electrical device; and at least one of said first and said second switching devices interposing a delay in said connecting and/or said disconnecting so that a voltage present across said common pair of conductors transitions between said control voltage and said operating voltage over a predetermined period of time.

9. The circuit in claim 8, wherein said control voltage is a Class-2 voltage and said operating power provides at least 100 volts.

10. In a circuit for selectively energizing an electrical device, a method comprising steps of:

closing a switch to initiate a first electrical current flow;

sensing said first current flow in at least one wire of a pair of conductive wires;

sensing a second current flow in at least one wire of said pair of conductive wires;

disconnecting a control voltage from at least one of said wires in a first switching device in response to said sensed first current and connecting an operating voltage to said conductive pair, said disconnecting and connecting occurring in a gradual manner with a delay so that both the control voltage and the operating voltage appear on a common pair ow conductive wires but at different times; and maintaining said operating voltage to said conductor pair in response to said sensed second current.

11. A control circuit for selectively energizing at least one electrical device coupled to said control circuit via a single two-wire pair of electrical conductors with an operating voltage, said control circuit comprising:

a control circuit for selectively supplying and withholding operating electrical power to said at least one electrical device over said single two-wire pair of electrical conductors;

a first current detector connected to a control voltage and sensing a current flow resulting from closure of a circuit connected to a control voltage in at least one wire of said single two-wire pair of conductors;

a second current detector connected to said operating voltage and sensing a current flow resulting from closure of a circuit connected to said operating voltage in at least one wire of said single two-wire pair of conductors;

a first switching device responsive to said first current detector to disconnect said control voltage from at least one of said wires and to connect said operating voltage to said single two-wire pair of conductors;

a second switching device responsive to said second current detector to maintain said operating voltage to said single two-wire pair of conductors;

said second switching device responsive to said second current detector to connect said operating power to said electrical device; and said control voltage and operating voltage being provided over said single two-wire pair of conductors, a time delay being provided for transition between the time said single pair of conductors carry said control voltage and carry said operating voltage.

12. The control circuit in claim 11, wherein said control voltage is a class-2 voltage and said operating voltage sufficient to provide sufficient voltage and current for operating said electrical device.

13. The control circuit in claim 12, wherein said operating voltage is a voltage in the range between about 100 volts and about 250 volts.

14. The control circuit in claim 13, wherein each of said first and second current detectors comprise an optical photocell pair including a light emitting portion and a light detecting portion, said light emitting portion operating when a sufficient current passes through said light emitting portion, said light detecting portion disposed to collect and sense light emitted by said light emitting portion and causing generation of a signal for controlling another circuit device.

15. A control system for selectively energizing and supplying power to a central and a remote electrical load device interconnected by a single conductor pair from a common control located at the remote device comprising:

low voltage circuit having a value of voltage not hazardous for personnel for sensing when said common control is connected and activated;

power means at the location of the central electrical device for providing power to the conductor pair interconnecting said central device with the remote electrical device, said power means providing electrical voltage to said conductor pair;

said common control comprising switching means interposed in one conductor of said pair for conducting the flow of electrical current to said remote device, said switching means comprising a switch having a first position for conducting electrical current to said remote electrical device and a second position for preventing the conducting of electrical current to said remote device;

first detecting means at the location of said control device connected to said low voltage and interposed in one conductor of said pair for detecting an electrical current flow through said conductor pair, said detecting means comprising a current sensing device interposed in one of said pair;

second detecting means at the location of said control device connected to said power means and interposed in one conductor of said pair for detecting an electrical current flow through said conductor pair, said detecting means comprising a current sensing device interposed in one of said pair;

first actuating means responsive to current flow detected by said first detecting means for disconnecting said low voltage from said conductor pair and connecting said power means to said conductor pair;

second actuating means responsive to current flow detected by said second detecting means for maintaining connecting said power means to said conductor pair; and said second actuating means responsive to current flow detected by said second detecting means for further connecting said power means to said central electrical device; and a circuit delaying said first actuating means disconnecting said low voltage from said remote electrical device and connecting said power means to said remote electrical device responsive to said first detecting means for a predetermined time.

16. The control system of claim 15, wherein said first and said second detecting means each comprises a current sensing device interposed in one of said conductor pair.

17. A control system operating at a Class-2 voltage for selectively energizing and supplying operating power to a central electric load device and to a remote electric load device interconnected by a single two-wire conductor pair which conducts a single current circuit only from a common control located at the remote device comprising:

an electrical power providing circuit at the location of the central electrical device for providing electrical power to said central device, electrical power to said remote device, and a Class-2 voltage and an electrical current for the single circuit of the conductor pair interconnecting said central device with the remote electrical device;

a first switch interposed between said electrical power providing circuit and said central device for controlling the flow of electrical current to said central device;

a second switch at the location of said remote device and interposed in one conductor of said pair for controlling the flow of electrical current to said remote device;

a current sensor at the location of said central device and interposed in one conductor of said pair, said current sensor generating a control voltage in response to a flow of current through said conductor pair;

an actuator responsive to said current sensor and coupled to said first switch for actuating said first switch in response to the control voltage generated by said current sensor; and a circuit delaying said first actuating means disconnecting said low voltage from said remote electrical device and connecting said power means to said remote electrical device responsive to said first detecting means for a predetermined time.

18. A control system as in claim 17, wherein said common control comprises a switch.

19. A control system as in claim 17, wherein said actuating means comprises a triac.

20. A control system as in claim 17, wherein said central device comprises an electrical motor.

21. A control system as in claim 17, wherein said current sensor comprises a current sensing transformer.

22. A control system as in claim 17, wherein said current sensor comprises a relay coil.

23. A control system as in claim 17, wherein said current sensor comprises a four-diode bridge circuit and photocell including a photoemitter and a photodetector.

24. A control system as in claim 17, wherein said remote device comprises an agitator motor.

25. A residential electrical system comprising:

means for receiving a potentially hazardous electrical utility line voltage and current;

a control circuit for applying a safe class-2 voltage to a single two-conductor pair of wires under first predetermined conditions and said potentially hazardous electrical utility line voltage to the same electrical two-conductor pair of wires under second predetermined conditions; and a transition between said class-2 voltage and said potentially hazardous electrical utility voltage being initiated by a change in open/closed state of a switch.

* * * * *